United States Patent [19]

Wesner

[11] Patent Number: 5,067,722

[45] Date of Patent: Nov. 26, 1991

[54] METHOD OF PLAYING A BOARD GAME

[76] Inventor: Francis P. Wesner, 151 Buck Ave., Johnstown, Pa. 15902

[21] Appl. No.: 560,455

[22] Filed: Jul. 27, 1990

Related U.S. Application Data

[63] Continuation of Ser. No. 469,695, Jan. 24, 1990, abandoned, which is a continuation of Ser. No. 300,700, Jan. 19, 1989, abandoned, which is a continuation of Ser. No. 143,250, Dec. 29, 1987, abandoned, which is a continuation of Ser. No. 865,983, May 21, 1986, abandoned.

[51] Int. Cl.[5] ..... A63F 3/00

[52] U.S. Cl. ..... 273/248

[58] Field of Search ..... 273/248, 249

[56] References Cited

U.S. PATENT DOCUMENTS 1,362,218 12/1920 Beloin ..... 273/248
1,406,484 2/1922 Paris ..... 273/248

FOREIGN PATENT DOCUMENTS 847890 10/1939 France ..... 273/249
18024 of 1891 United Kingdom ..... 273/248

*Primary Examiner*—Benjamin Layno

*Attorney, Agent, or Firm*—Lowe, Price, LeBlanc & Becker

[57] ABSTRACT

There is disclosed a method of playing a board game. The game is played on a board having a pathway in the outline of a cruciform with equal length arms extending outwardly from a common center and disposed at 90 degree angles around the board. At the end of each arm is an individual player's home position with four positions, one for each of his markers. Each player's home positions and markers are a different color and two teams are formed with the players opposite each other being partners. When the player rolls a one or a six he is permitted to leave the home position to the start position with one of his markers. On each successive roll of one or six another marker may be moved out of the home position. A six entitles the player to another roll. At the intersection of the arms are safe positions wherein a player cannot be disturbed. If a player occupies the same position as an opponent other than a safe position the opponent's marker returns to its home position. The first pair of partners to advance all four markers around the pathway counterclockwise and return their individual markers to the four positions designated within the arms adjacent the individual partner's home positions wins the game.

2 Claims, 2 Drawing Sheets

METHOD OF PLAYING A BOARD GAME

This application is a continuation of application Ser. No. 07/469,695 filed Jan. 24, 1990, which is a continuation of Ser. No. 07/300,700 filed Jan. 19, 1989, which is a continuation of Ser. No. 07/143,250 filed Dec. 29, 1987, which is a continuation of Ser. No. 06/865,983 filed May 21, 1986. All the above continuation applications now abandoned.

BACKGROUND OF THE INVENTION

This invention relates to a board game wherein opponents attempt to move pieces in the same direction around a pathway from different starting points. A player attempts to frustrate an opponent's advance by blocking the pathway or returning a players piece to its starting point. The game may be played by two, three or preferably four players, with pairs being partners. The object of the game is for an individual player, in the case of two or three players, or a pair of partners to complete movement of all pieces through the pathway from the starting point to the ending point.

The prior art contains several patents related to board games which are payable by multiple players and which include movement of the players pieces along a pathway from a starting point to an ending point based on a throw of the dice. For example in U.S. Pat. No. 1,383,185 the main pathway is around the periphery of a square board with "home stretches" radiating from a central point at right angles to each other. Similarly in U.S. Pat. No. 1,406,484 the pathway is in the outline of a square. The home position however is not the center of the square but rather designated positions within one of the arms. In this device however each player only has a single piece on the board at a time and therefore the opportunity for strategy is lacking. In further example, in U.S. Pat. No. 1,362,216, the pathway is in the outline of a cross having equal arms and safe zones are provided at the intersection of the arms. The home position however is in the center, and does not provide for multiple pieces in action at the same time to provide for strategies to be developed by individual players.

BRIEF SUMMARY OF THE INVENTION

Accordingly, this invention is a method of playing a game which may be played by children or adults or by families. The complexity depends upon the strategies used by the players. Although the advance of each player is dictated by the throw of a die, the game is susceptible to considerable skill in devising said strategies, in addition to luck.

Accordingly, it is an object of this invention to provide a board game which may be played by a wide variety of ages of players without alteration of the rules, playing surface, or playing pieces.

It is another object to provide a board game which is playable both by adults, children, or families, wherein the board defines a segmented pathway through which individual pieces must move wherein an opponents movement may be frustrated by blocking the pathway or sending the opponents piece back to its starting position.

It is still another object of this invention to provide a board game particularly suited to be played by two pair of partners wherein individual pieces move subject to the throw of a die around a segmented pathway with all pieces moving in the same direction wherein the object is to circumnavigate the pathway from start to finish with all pieces so that the partner finishing first may use his turn to move his partner's pieces whereby the first pair of partners to move all pieces to the respective finishing points wins the game.

BRIEF DESCRIPTION OF THE DRAWING

These and other objects will be readily apparent with reference to the drawing and following description wherein.

DETAILED DESCRIPTION OF THE INVENTION

Figure 1:
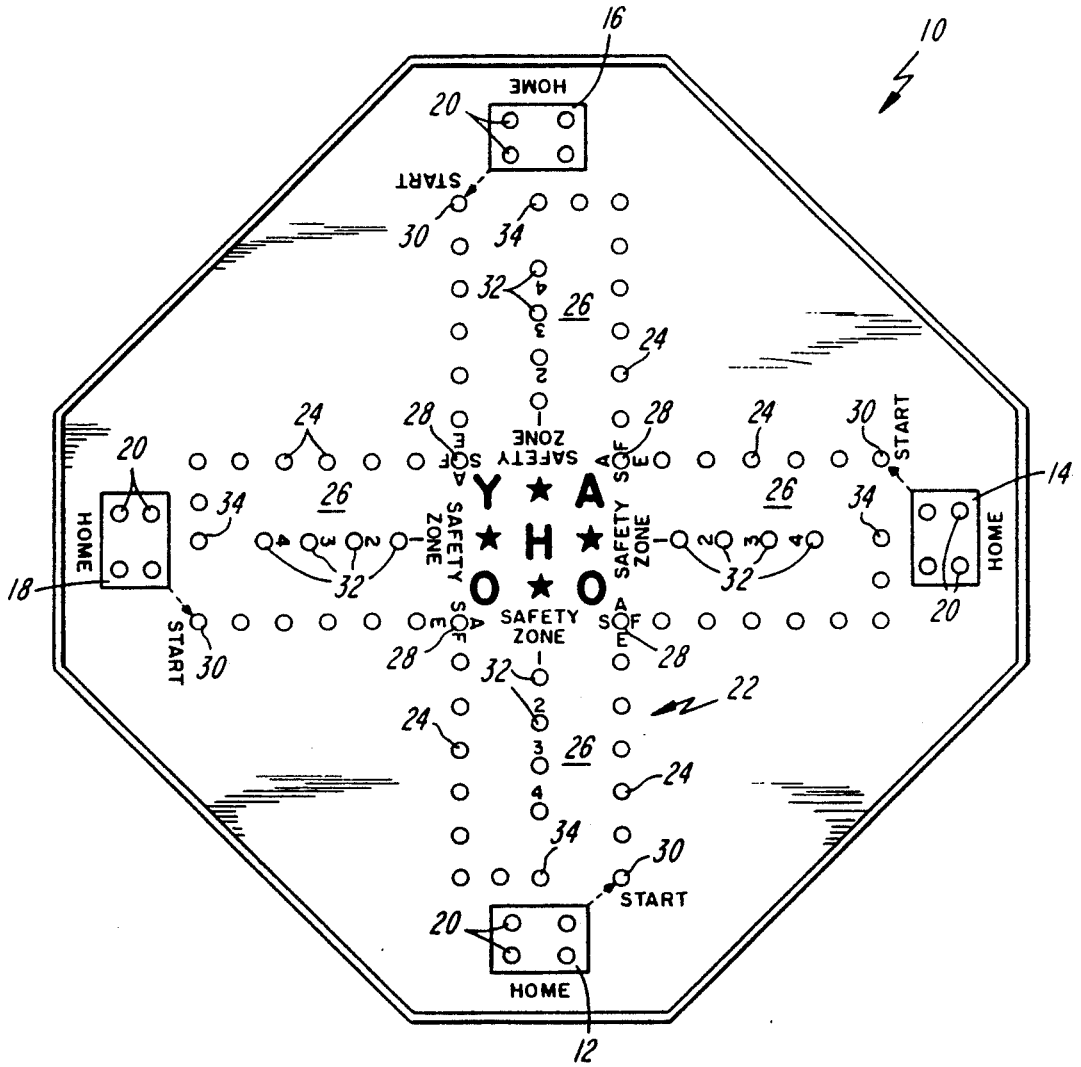
FIG. 1 is a top view of the board of this invention.
Figure 2:
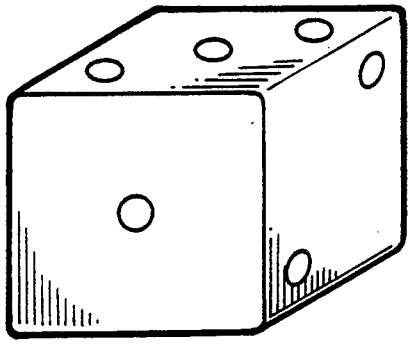
FIG. 2 is a perspective view of the die used in the game.
Figure 3:
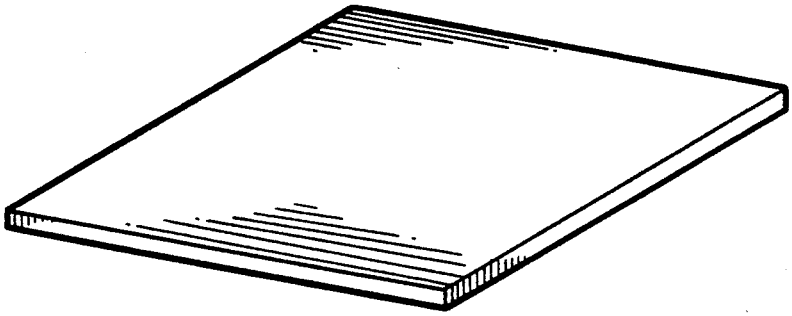
FIG. 3 is a perspective view of a marker used in the game.

With attention to the drawing showing the board of this invention 10, each player is assigned a color initially such as red, gold, blue, and green. Partners are paired according to color such as red and gold vs. blue and green and sit opposite each other at the board 10. For example, the home position for red would be designated 12, and colored red. Blue would be designated 14, gold 16 and green 18. Each home position 12, 14, 16 and 18, contains four starting positions 20 for four colored markers (not shown) to initiate the game. The markers may be beads, discs, or the like. The pathway for advance 22 is segmented by individual circles 24 and is in the form of the outline of a cruciform or Saint Georges cross with circles 24 defining four intersecting arms 26 of equal length. A safe position 28 is located at the intersection of each of said arms 26. A starting position 30 is located to the right adjacent each home position 12, 14, 16, and 18. A safety zone consisting of four positions 32 is centrally disposed within each arm 26. Positions 32 are preferably disposed along the longitudinal axis of each arm in alignment with the position 34 which is each players end of the pathway 22.

To initiate play, each player is issued four markers (not shown) and a single die (also not shown) and the markers are placed on the respective positions 20 in the players home starting point.

While it is preferred to use four players playing as partners, and the following description will be so directed, it will be obvious that two or three players equally can play, or four may play not playing as partners without substantially altering the rules.

In order to start play, each player rolls his die and the highest number begins. In case of a tie the roll is repeated. Play proceeds counterclockwise around the board. In order for a player to move a marker from the home position 20 to the start position 30 it is necessary to roll either a one or a six. If a different number is rolled the player's turn passes to the next player and so around the board. Whenever a player rolls a six, the player may roll again and continue so long as sixes are rolled.

If a player advances a marker to a circle 24 occupied by the marker of another player, the other player's marker must be returned to a home position 20. A player also may never "jump" one of his own markers.

When a marker comes to rest on a safe circle 28, the marker may remain there indefinitely and another player cannot occupy that position. However, as noted above, a player must move with each roll of the dice if at all possible. Therefore, if the only move possible is to vacate a circle 28, that move must be made. Finally, after passing the first circle 28 a player may back-up if desired. However, the intention to back-up must be announced before rolling the die. For example, if a player has his first marker on the start position 30 with the remaining three markers in the home positions 20 and rolls a six he must advance from position 30 to the first safe position 28. No other move is possible because the marker at position 30 blocks exit from the home position 20. He then gets another roll of the die. If the second roll is for example a two, one of the three remaining markers in home positions 20 cannot be moved out of the home position to the start position 30. Therefore the only move remaining is to advance counterclockwise and vacate the safe position 28.

In another example if the player has only a single marker out of the home position in the start position 30 and rolls a six, the marker in position 30 must be moved. One of the markers in a home position cannot leave home because to do so it would "jump" over the marker in position 30, and it is not permitted for a player to "jump" his own marker. If however the position 30 is occupied by an opposing player's marker, or even the marker of the player's partner, and a one is rolled, one of the markers from the home position can occupy the start position 30 and the marker perviously occupying such position must be returned to its home position. When a marker has successfully circumnavigated the pathway 22 it enters the player's safety zone in the arm 21 in front of the player's home and occupies a position 32. Only a player's own markers can enter the player's respective safety zone. Furthermore, if the marker occupies the end position 34, in order to enter the safety zone the player must roll either a one, two, three, or a four. Since the players markers cannot jump each other, the marker must be moved into the safety zone to the farthest remaining unoccupied position by rolling the correct number on the die.

For example, if a marker is in position 34 and a two is rolled so that the marker advances two positions into the safety zone, another two must be rolled in order to move the marker to the farthest remaining unoccupied position in the safety zone.

Finally, when one player has moved all markers successfully into his safety zone, he then assists his partner by using his turn to advance his partner's markers.

While the game play depends upon the roll of a die, strategies can be developed such as blocking advance by occupying a safe position 28 indefinitely. Also by selecting which piece to advance, a player may occupy a position 24 occupied by an opponent and thereby send the opponent's marker back to its respective home position. Similarly, a player can avoid doing this with his partner's marker unless, as previously indicated the marker happens to occupy a start position and there is no other recourse but to move a marker from home to the start position.

In summary, the game board of this invention is designed for four players each playing with four markers, each player has a color coated home position with partners positions disposed opposite each other.

The path of advance is in the outline of a cruciform having arms of equal length which intersect at a common midpoint so that the planes containing each arm are disposed at 90 degree intervels around a midpoint. Each arm defines a player's respective safety zone and preferably the positions within the safety zone extend along the longitudinal axis of the arm toward the midpoint. Six positions are provided longitudinally along each arm and on each side thereof with the intersecting four positions being safe positions.

The rules of play requires that a marker may not move from the home position to the start position unless the player can roll a one or a six. In that event, if there are other markers on the board, the player may elect whether to advance a marker along the pathway, or bring another marker out of the home position if a one or a six is rolled. In the event a six is rolled, the player has another turn and can continue taking additional turns until he no longer rolls a six. Once a marker passes the first safe position at the intersection of two arms, the player may move his marker either forward or backward with each roll of the die. However, if the marker is to move backward, that intention must be announced before the die is rolled. A marker may remain in the safe zone, indefinitely whereas a marker disposed on the pathway may be sent to home if a opponent's marker occupies the same position. A player however cannot permit one of his markers to advance beyond another, or "jump" over it. If a player has no move available however the turn it forfeited.

The game is completed when a player has circumnavigated the pathway with all four markers and has advanced said markers correctly into the safety zone. At this point, a player may assist his partner by using his turn to move his partner's markers. When both partners have moved their markers into their respective safety zones, the game is complete.

This invention may be embodied in other specific forms without departing from the spirit or essential characteristics thereto. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A method of playing a board game playable by up to four players comprising the steps of:

providing four sets of movable markers, each set having a plurality of commonly colored markers, said sets being distinguishable from each other wherein the markers of one set being or a different color than the markers of the other sets, providing four individual die members, and providing a board having inscribed on the playing surface thereof a segmented pathway in the outline of a cruciform having arms of equal length radiating from a common center, each arm having a longitudinal axis with a plurality of end positions mutually spaced therealong one position for each marker in a set, said pathway formed by seven positions lying along axes on the right and left sides of the longitudinal axis, parallel to and equidistantly spaced from said axis with the seventh position being common to the next adjacent arm, each arm terminating in two positions contained in a plane normal to the longitudinal axis of the arm with one position on said axis and the other in alignment with the end position on the left hand outline or pathway axis, the four common seventh positions being designated safe and the distal end position on the right side of each arm being designated, start; four rectangular home positions, one located at the end of each arm and centered on the longitudinal axis thereof, each home position being the color of a different marker set and containing a plurality of marker home positions, assigning each player set of markers and a die;

dividing the players into two teams wherein each player has a partner;

placing said markers on their respectively colored home positions;

each player rolling their die in turn, when a player rolls a predetermined number on said die said player moving one of his assigned markers to said respective start position;

each player, in turn, continuing the rolling of their dice and alternatively advancing along the pathway only their said assigned markers, which were previously placed on said start position, or moving only one of their said assigned markers from said respective home position to said respective start position according to the die roll;

said advancing markers only one circuit around said pathway and then moving said markers toward their respective end positions;

when a first player has successfully advanced his assigned set of markers into his respective end positions before his partner does, said first player maintaining his turn and assisting his partner by using his turn to roll his die and advance his partner's markers, the team advancing both their sets of markers into their respective end positions first, being the winner.

2. The game board of claim 1 wherein four marker home positions and four end positions are provided on each arm.

* * * * *